US005896748A

United States Patent [19]

Park

[11] Patent Number: 5,896,748

[45] Date of Patent: Apr. 27, 1999

[54] CONTROL METHOD AND COOK-CHILL SYSTEM OF A REFRIGERATOR/FREEZER COMBINATION

[75] Inventor: Eun-Kyung Park, Incheon, Rep. of Korea

[73] Assignee: Daewoo Electronics Co., Ltd., Rep. of Korea

[21] Appl. No.: 08/959,988

[22] Filed: Oct. 29, 1997

[30] Foreign Application Priority Data

Oct. 30, 1996 [KR] Rep. of Korea ..... 96-50371

[51] Int. Cl.[6] ..... F25D 17/06

[52] U.S. Cl. ..... 62/179; 62/186; 62/157; 62/419; 62/441

[58] Field of Search ..... 62/186, 180, 179, 62/187, 157, 231, 419, 441, 447, 229, 203

[56] References Cited

U.S. PATENT DOCUMENTS

| | | | |
|---|---|---|---|
| 3,747,361 | 7/1973 | Harbour | 62/157 |
| 3,759,053 | 9/1973 | Swaneck, Jr. | 62/231 X |
| 4,358,932 | 11/1982 | Helfrich, Jr. | 62/186 X |
| 4,368,622 | 1/1983 | Brooks | 62/419 X |
| 5,263,332 | 11/1993 | Park | 62/157 |

*Primary Examiner*—Harry B. Tanner
*Attorney, Agent, or Firm*—Pillsbury Madison & Sutro, LLP

[57] ABSTRACT

A control method and a cook-chill system of a refrigerator/freezer combination which preserves for a long time the taste of foodstuffs after a cooked foodstuff is refrigerated rapidly and is stored by supplying a lot of chilling air of a freezing chamber into a cook-chill chamber are disclosed. The cook-chill chamber has a three-dimensional storage space for chilling rapidly and preserving cooked foodstuffs, has a first chilled air inlet hole connected with a first chilling air duct which is prolonged from a freezing chamber of which one side of the upper side has a second chilled air inlet hole connected with a second chilling air duct which is prolonged into a refrigerating chamber from a freezing chamber. Also, a cook-chill chilling fan is provided at the first chilled air inlet hole and allows the chilling air in the freezing chamber to flow into the cook-chill chamber, and a cook-chill circulation fan is provided at the second chilled air inlet hole for circulating the chilling air in the cook-chill chamber. A cook-chill operating switch enables a user to turn on/off an operation of the cook-chill system, and a control unit drives the cook-chill chilling fan and the cook-chill circulation fan according to an output signal of the cook-chill operating switch.

14 Claims, 4 Drawing Sheets

CONTROL METHOD AND COOK-CHILL SYSTEM OF A REFRIGERATOR/FREEZER COMBINATION

BACKGROUND OF THE INVENTION

1. Field of the Invention

The present invention relates to a control method for controlling an inner temperature in a refrigerator/freeze combination and a cook-chill system for performing the same, and more particularly to a control method and a cook-chill system of a refrigerator/freezer combination which can refrigerate rapidly a stored foodstuff by controlling a supply of a chilled air about a cook-chill chamber of a refrigerator/freezer combination in order to preserve a taste of a cooked foodstuff.

2. Description of the Prior Art

Generally, a refrigerator/freezer combination is an apparatus for refrigerating and storing foodstuffs at a relatively low temperature and comprises a freezer compartment and refrigerator compartment. Recently, in the technical field of refrigerators, many refrigerator products which are easy to use and have a variety of improvements, for example, many refrigerators which can improve the refrigerating efficiency by increasing in number of coolers in the refrigerator chamber or which can reduce the refrigerator's power consumption, are widely used.

Particularly, in the refrigerator, many methods have been suggested in order to maximize a freezing or a refrigerating efficiency and to minimize a refrigerator's power consumption.

For example, in the U.S. Pat. No. 5,263,332, when the door of the refrigerating chamber opens and closes, a method for increasing refrigerating efficiency by lowering an elevated inner temperature of the refrigerating chamber by introducing air from outside, is disclosed.

In this refrigerator, opening and shutting times of the door of the refrigerating chamber are checked. Then, the compressor and the fan are controlled in order to supply chilled air by measuring the opening and shutting time difference. Also, the inner temperature of the refrigerating chamber is reset to a lower temperature than an early setting temperature by the opening and shutting time difference. When the reset temperature is set, the compressor and the fan are driven until the inner temperature of the refrigerating chamber reaches the reset temperature so that the elevated inner temperature of the refrigerating chamber is lowered.

However, when considering the various needs of a consumer, it is necessary to improve a refrigerating efficiency of the refrigerator as well as to have the above functions. In addition, when refrigerating cooked foodstuffs, a refrigerator which can keep fresh cooked foodstuffs for a long period of time is needed in order to satisfy a consumer's need.

When just cooked foodstuffs are stored immediately in the refrigerator chamber, because of the emitting of heat from the cooked foodstuffs, an inner temperature of the refrigerating chamber rises, thereby resulting in a wasting of power and in a reduced efficacy in keeping foodstuffs fresh. Placing the hot foodstuffs in the refrigerator chamber after cooling the foodstuffs outside the refrigerator or in the freezer chamber in order to avoid a power loss and a harmful effect in freshness, is inconvenient and cannot naturally preserve the taste of the cooked foodstuffs.

Incidentally, it is known that the fresh state of cooked foodstuffs can be maintained for a long time and that the taste of cooked foodstuffs stored in the refrigerator can be naturally preserved when the cooked foodstuffs is rapidly cooled. However, there are still no example of a refrigerator which applies these principles.

SUMMARY OF THE INVENTION

The present invention is intended to overcome the above described disadvantages. Therefore, it is a first object of the present invention to provide a control method of a cook-chill system of a refrigerator/freezer combination which is able to refrigerate rapidly the cooked foodstuffs stored in the cook-chill chamber, which is an independent space positioned between a conventional refrigerating chamber and a freezing chamber, and which is able to increase a refrigerating efficiency by forcibly circulating and supplying simultaneously the chilled air of the freezing chamber for a short time.

In addition, it is a second object of the present invention to provide an apparatus for controlling a cook-chill system of a refrigerator/freezer combination which is able to execute the above control method.

In order to achieve the above first object of the present invention, there is provided a method for controlling a cook-chill system of a refrigerator/freezer combination, the method comprising the steps of: (a) supplying first chilled air into a cook-chill chamber through a first chilled air inlet hole of the cook-chill chamber by driving a cook-chill chilling fan when receiving system operating instructions, the first chilled air being circulated to an evaporator from a freezing chamber; (b) supplying second chilled air into the cook-chill chamber through a second chilled air inlet hole of the cook-chill chamber, the second chilled air being circulated in a chilling air duct for connecting a refrigerating chamber with a refrigerator fan, circulating the first and second chilled air in the cook-chill chamber by driving simultaneously a cook-chill circulation fan and the cook-chill chilling fan, and discharging the circulated chilled air through a chilled air discharge hole of the cook-chill chamber; and (c) controlling the driving of the cook-chill chilling fan and the cook-chill circulation fan to lower an inner temperature of the cook-chill chamber below a predetermined temperature.

For effective controlling of the system, it can use a target temperature value instead of an operating time, or can use both the operating time and the target temperature.

In order to achieve the above second object of the present invention, there is provided an apparatus for a cook-chill system of a refrigerator/freezer combination which includes: (a) a cook-chill chamber which is a three dimensional storage room for chilling rapidly and preserving a cooked foodstuff, and has a first chilled air inlet hole formed at an upper side thereof which is connected with a first chilling air duct between an evaporator and a freezing chamber, and has a second chilled air inlet hole formed at a side thereof adjacent to an upper layer connected with a second chilling air duct extending to a refrigerating chamber from the freezing chamber; (b) a cook-chill chilling fan which is provided at the first chilled air inlet hole, for flowing forcibly a chilled air in the first chilling air duct into the cook-chill chamber; (c) a cook-chill circulation fan which is provided at the second chilled air inlet hole, for circulating the chilled air in the cook-chill chamber; and (d) a control means for controlling the driving of the cook-chill chilling fan and the cook-chill circulation fan in order to lower an inner temperature of the cook-chill chamber below a predetermined temperature.

In addition, the cook-chill chamber further comprises: a chilled air discharge hole provided at a neighboring side of the cook-chill chamber for sending out the circulating chilled air in the cook-chill chamber; and a chimney hole provided in order to enable flowing of the chilled air in the refrigerating chamber, to flow into the cook-chill chamber.

An advantage of the control method and the apparatus for the cook-chill system of the refrigerator/freezer combination according to the present invention is that it can preserve the taste of cooked foodstuffs and increase the refrigerating efficiency of the cook-chill chamber by forcibly supplying and circulating the chilled air of the freezing chamber, while preventing a harmful influence on the keeping fresh of other foodstuffs in the refrigerating chamber by rapidly refrigerating the cooked foodstuffs.

BRIEF DESCRIPTION OF THE DRAWINGS

The above object, characteristics and other advantages of the present invention will become more apparent by describing in detail a preferred embodiment thereof with reference to the attached drawings in which.

DESCRIPTION OF THE PREFERRED EMBODIMENT

Hereinafter, a control method and an apparatus for a cook-chill system of a refrigerator/freezer combinations according to a preferred embodiment of the present invention will be explained in more detail with reference to the accompanying drawings.

Figure 1:
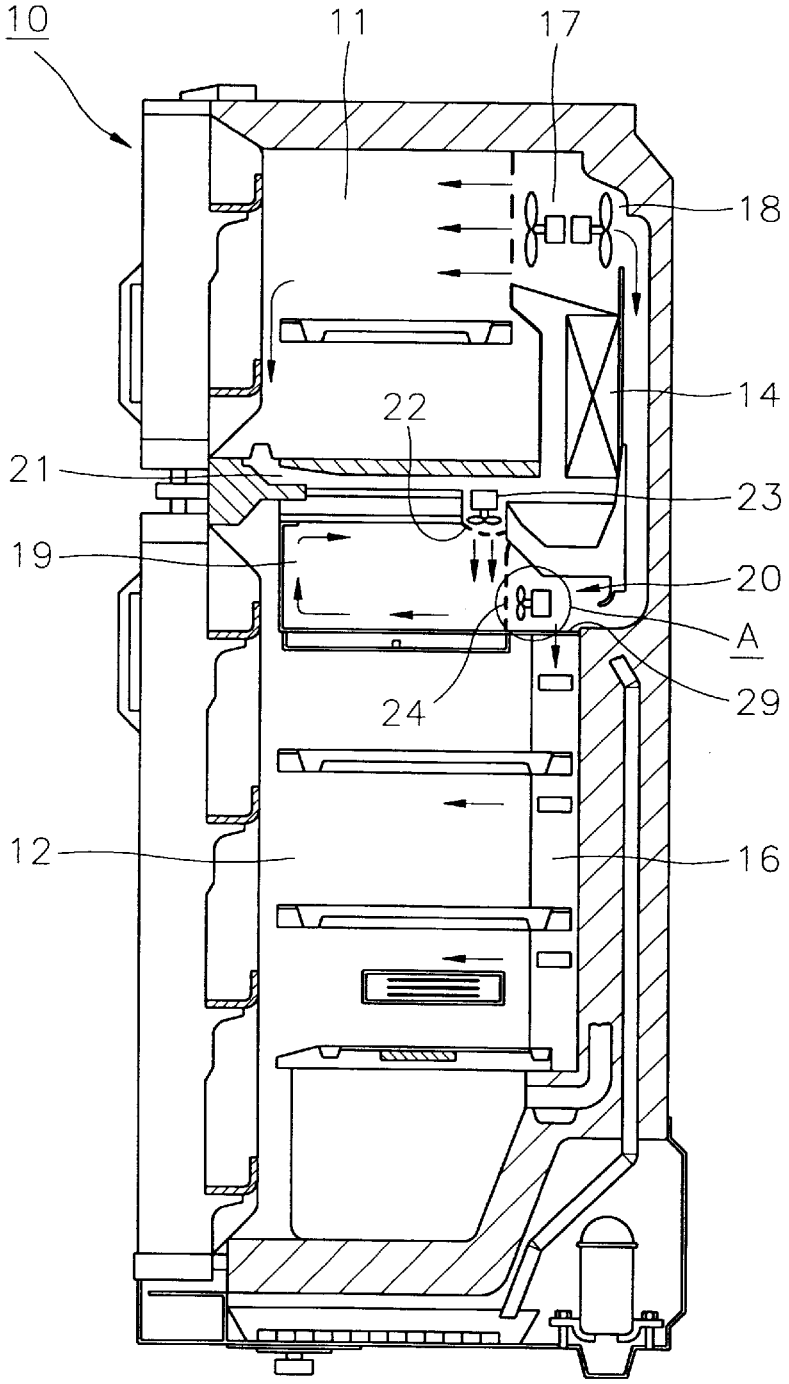
FIG. 1 is a side sectional view showing an apparatus of a refrigerator/freezer combination with a cook-chill system according to one embodiment of the present invention.

FIG. 1 is a schematic sectional view showing an apparatus of a refrigerator/freezer combination with a cook-chill system according to one embodiment of the present invention.

Referring to FIG. 1, a freezer fan 17 and a refrigerator fan 18 are provided above an evaporator 14, for respectively supplying into a freezing chamber 11 and a refrigerating chamber 12 the air chilled by the evaporator 14. At an upper side of the refrigerating chamber 12, a cook-chill chamber 19 is provided in order to keep fresh cooked foodstuffs.

At a back side of the upper layer of the cook-chill chamber 19 is provided a first chilled air inlet hole 22 connected with an outlet 21, through which the chilled air from the freezing chamber 11 is flowed towards the evaporator 14. A cook-chill chilling fan 23 for forcibly discharging the chilled air from the outlet 21 into the cook-chill chamber 19 is provided just behind the first chilled air inlet hole 22.

In addition, at a rear side of the cook-chill chamber 19 is provided a second chilled air inlet hole 24 which is connected with first and second chilling air ducts 15 and 16 for circulating into the refrigerating chamber 12 the chilled air supplied by the refrigerator fan 18. At the back side of the second chilled air inlet hole 24 is provided a cook-chill circulation fan 20 for flowing into the cook-chill chamber 19 the chilled air in the first chilling air duct 15 for circulating the chilled air supplied by the refrigerator fan 18 into the refrigerating chamber 12, and in the second chilling air duct 16 which is located between the refrigerating chamber 12 and the cook-chill chamber 19.

The positions of the first chilled air inlet hole 22 and the second chilled air inlet hole 24 shown in FIG. 1 need not be fixed at the upper rear side and the back side of the cook-chill chamber 19, respectively. For example, although other positions lead to some disadvantage in the circulation of chilled air or in the manufacturing of the refrigerator/freezer combination, the first chilled air inlet hole 22 can be placed at the head of the upper layer, or the second chilled air inlet hole 24 can be placed at any other side.

In addition, the structure of the cook-chill chamber 19 can be designed so that the cook-chill chamber 19 is not provided with the first chilled air inlet hole 22 and the cook-chill chilling fan 23. In this case, the chilled air supplied by the refrigerator fan 18 is supplied forcibly into the cook-chill chamber 19 by the cook-chill circulation fan 20 as well as into the refrigerating chamber 12.

The above-mentioned distributing method of flowing the chilled air in two directions by the cook-chill circulation fan 20 reduces an early refrigerating efficiency since the sufficient chilled air for rapidly refrigerating the cooked and hot foodstuffs in early operation of the cook-chill system can not supplied into the cook-chill chamber 19. As a result, the efficiency of preserving taste of the foodstuff stored in the cook-chill chamber 19 according to the above-mentioned method is relatively low when compared to the method which flows into the cook-chill chamber 19 the chilled air supplied by both the freezer fan 17 and the refrigerator fan 18.

Figure 2:
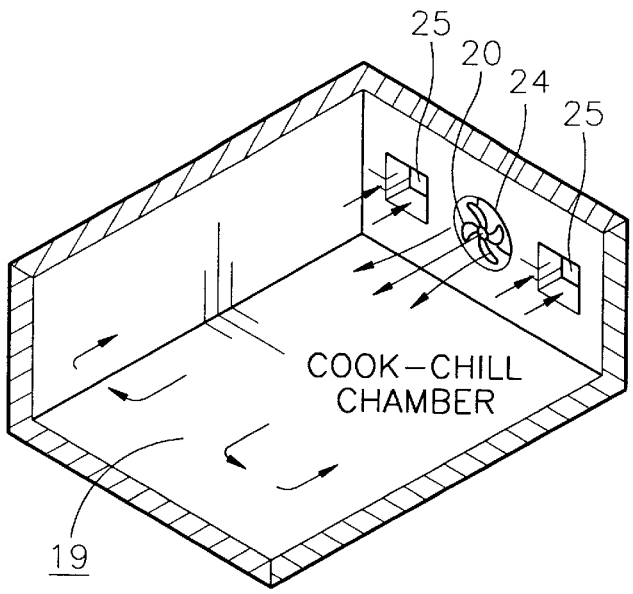
FIG. 2 is a perspective view showing a back side structure of the cook-chill chamber shown in FIG. 1, viewing from an inside of the cook-chill chamber.

FIG. 2 is a perspective view showing a back side structure of the cook-chill chamber shown in FIG. 1, viewing from an inside of the cook-chill chamber.

Referring to FIG. 2, at the back side of the cook-chill chamber 19 is formed at least one chilled air discharge hole 25 in order to increase the refrigerating efficiency by circulating the chilled air into the cook-chill chamber 19 in addition to the second chilled air inlet hole 24. In order to uniformly circulate the chilled air into the cook-chill chamber 19, the second chilled air inlet hole 24 is desirably located at the center of the back side of the cook-chill chamber 19, and the chilled air discharge hole 25 is provided respectively at the left and right sides of the second chilled air inlet hole 24.

The chilled air in the chilling air duct 16 is circulated and flowed through the second chilled air inlet hole 24 into the cook-chill chamber 19 by a cook-chill circulation fan 20, and the chilled air flows out of the cook-chill chamber 19 through the chilled air discharge hole 25.

Figure 3:
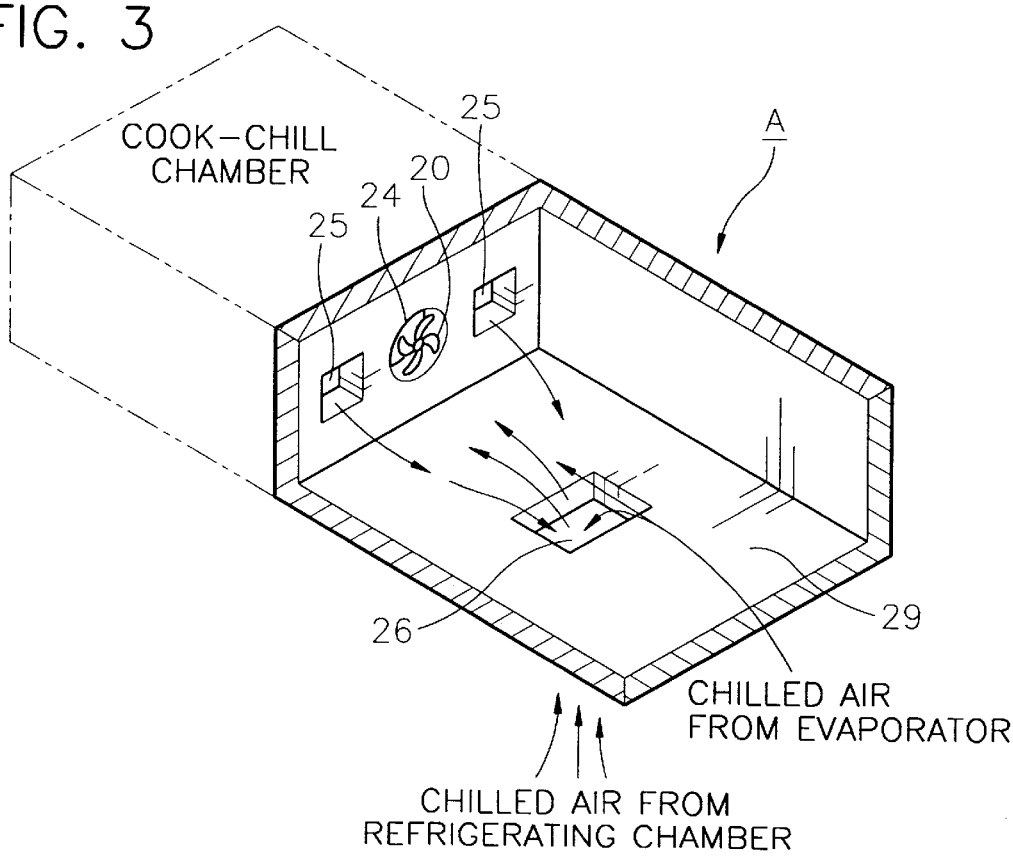
FIG. 3 is a perspective view showing an outer back side structure of the cook-chill chamber as shown in FIG. 1, at which there is formed an isolation wall between a rear space of the cook-chill chamber and a refrigerating chamber.

FIG. 3 is a perspective view showing an outer back side structure of the cook-chill chamber, at which there is formed an isolation wall 29 between a rear space (the portion A in FIG. 1) of the cook-chill chamber 19 which is provided with the second chilled air inlet hole 24 and the refrigerating chamber 12. The isolation wall 29 has a connection hole 26 to form the second chilling air duct 16 and to connect the refrigerating chamber 12 and the cook-chill chamber 19.

The refrigerator fan 18 is operated intermittently according to the temperature of the refrigerating chamber 12. At this time, the chilled air which flows into the cook-chill chamber 19 by the cook-chill circulation fan 20 is mostly the chilled air which has been cooled by the evaporator 14 and sent through the first chilling air duct 15 by the refrigerator fan 18. However, when the refrigerator fan 18 stops, the chilled air of the first chilling air duct 15 and the chilled air of the refrigerating chamber 12 flow into the cook-chill chamber 19 forcibly or naturally according to the operation of the cook-chill circulation fan 20.

Figure 4:
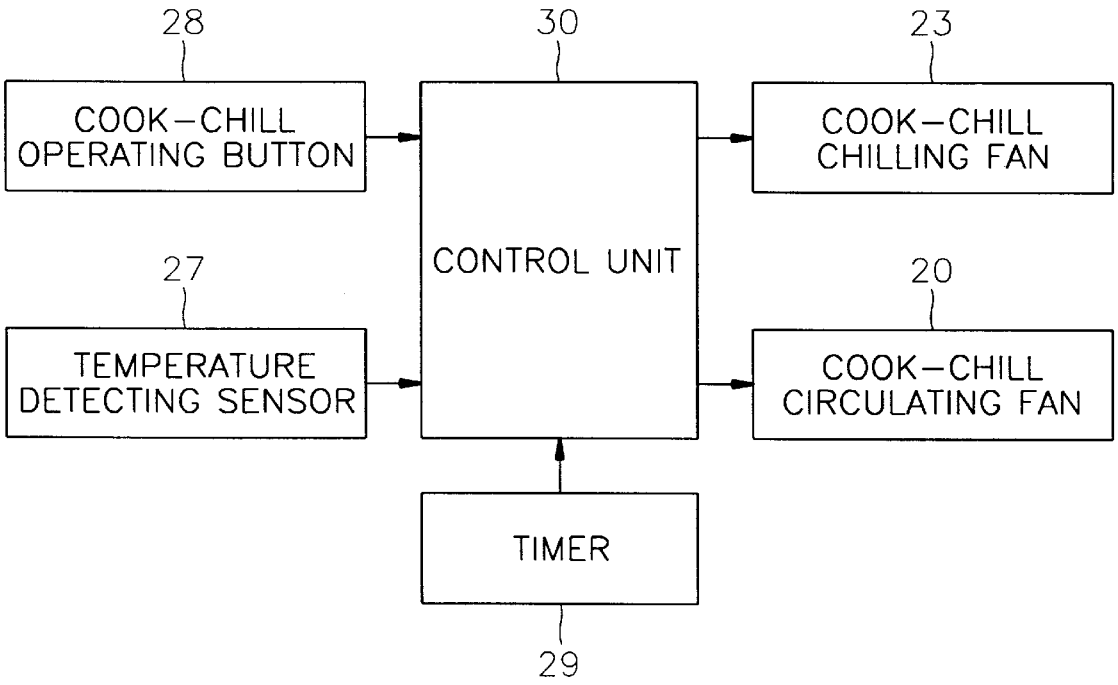
FIG. 4 is a block diagram showing a structure of a cook-chill system for explaining an operation of a cook-chill system according to one embodiment of the present invention.

FIG. 4 is a block diagram showing a structure of a cook-chill system for explaining an operation of a cook-chill system according to one embodiment of the present invention.

In FIG. 4, the same reference numerals are used for same parts as in FIG. 1, and a detail explanation about these parts is omitted. Referring to FIG. 4, reference numeral 27 represents a temperature detecting sensor for detecting an inner temperature of the cook-chill chamber 19. Reference numeral 28 denotes a cook-chill operating button for the operation of the cook-chill system by a user's selection. Reference numeral 29 denotes a timer for calculating an operating time of the cook-chill system. Reference numeral 30 denotes a control unit for driving the cook-chill chilling fan 23 and the cook-chill circulation fan 20 according to the cook-chill operating button 28, the temperature detecting sensor 27 and output signal of timer 29.

Figure 5:
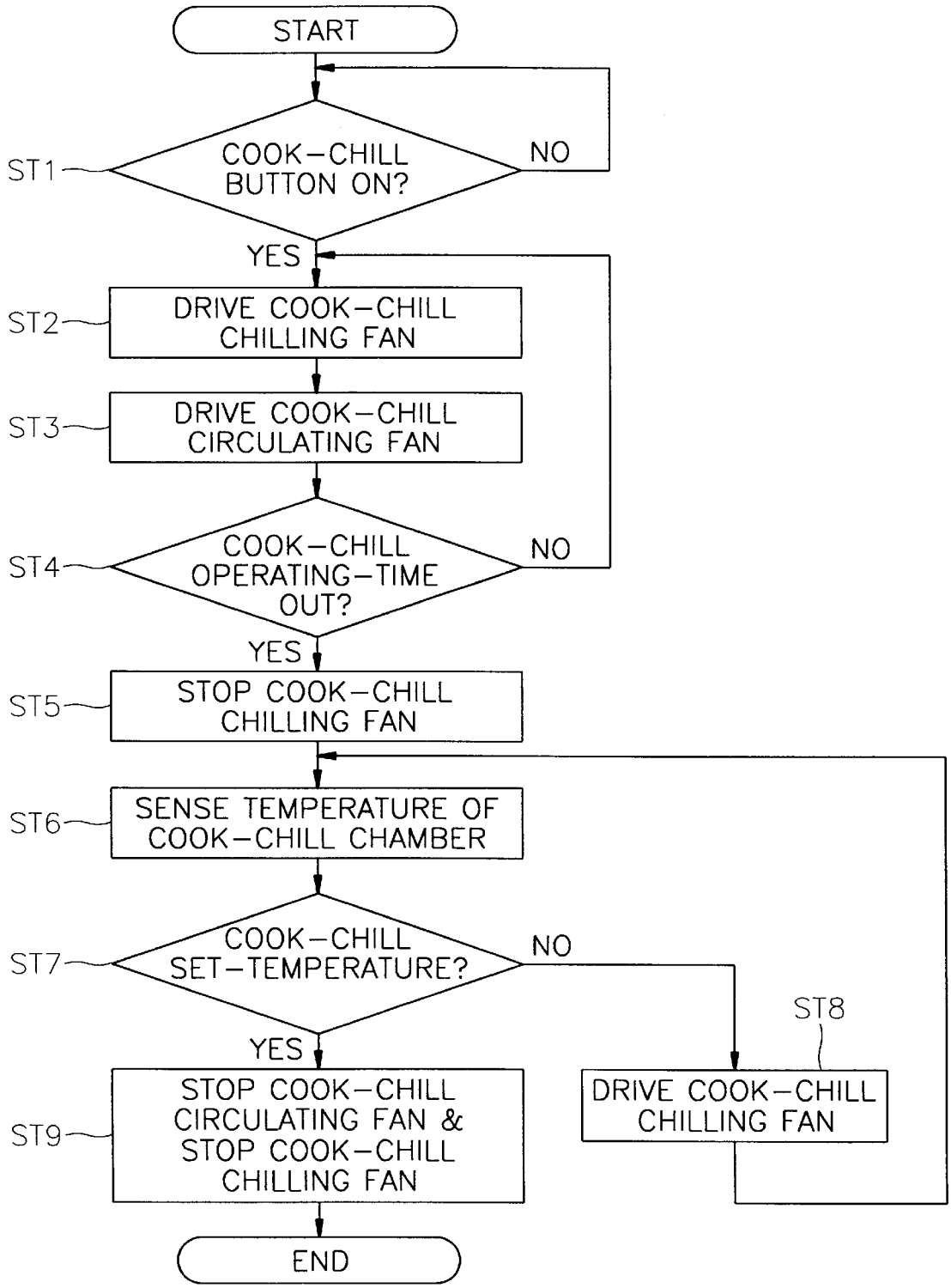
FIG. 5 is a flow-chart diagram explaining the operation of the cook-chill system according to one embodiment of the present invention.

Hereinafter, the operation of the cook-chill system according to the present invention will be explained with reference to the flow-chart in FIG. 5 and with reference FIGS. 1 to 4.

In order to operate the cook-chill system, a user turn on the cook-chill operating button 28 (step ST1). The control unit 30 drives the first the cook-chill chilling fan 23 (step ST2), and then introduces the chilled air circulating in the freezing chamber 11 into the cook-chill chamber 19. At the same time, the control unit 30 drives the cook-chill circulation fan 20 so that the chilled air which has been introduced into the cook-chill chamber 19 from the freezer 11 by the cook-chill chilling fan 23 is evenly circulated in the total cook-chill chamber 19 (step ST3). Namely, the control unit 30 drives the cook-chill circulating fan 20 so as to circulate forcibly a flowed chilling air in order to chill rapidly the cooked foodstuffs while introducing the chilled air in toe freezing chamber 11 into the cook-chill chamber 19 at early operation state of the cook-chill system after the cooked foodstuffs are stored into the cook-chill chamber 19.

Subsequently, the control unit 30 judges whether or not a predetermined time, which is a time adequate for chilling the cooked foodstuffs in the cook-chill chamber 19, has passed based on the counted time by the timer 29 (step ST4), and stops the driving of the cook-chill chilling fan 23 to stop the flow of the chilled air of the freezer chamber 11 into the cook-chill chamber 19 when the operating time of the cook-chill system reaches the predetermined time (step ST5).

In addition, the temperature detecting sensor 27 senses the inner temperature of the cook-chill chamber 19 to output the detecting signal (step ST6) to the control unit 30, which detects the inner temperature of the cook-chill chamber 19 based on the detecting signal (step ST7). In a case where the temperature of the cook-chill chamber 19 detected at the step ST6 is the fixed setting temperature or less, for example, three degrees Celsius, the control unit 30 judges that the stored foodstuffs of the cook-chill chamber 19 has been sufficiently cooled and stops the driving of the cook-chill circulation fan 20 (step ST9). In a case where the temperature of the cook-chill chamber 19 is higher than the fixed setting temperature, the control unit 30 drives the cook-chill chilling fan 23 in order to flow the chilled air of the freezer chamber 11 into the cook-chill chamber 19 again (step ST8). The driving of the cook-chill chilling fan 23 is continued until the temperature of the cook-chill chamber 19 decreases to the fixed setting temperature or less, in which case the control unit 30 stops the driving of the cook-chill chilling fan 23 and the cook-chill circulation fan 20 (step ST9).

As described above, while the cook-chill system cools rapidly the cooked foodstuffs by circulating for a predetermined time the chilled air of the freezer chamber 11 which has flowed into the cook-chill chamber 19 at the early operation of the cook-chill system, when the inner temperature of the cook-chill chamber 19 falls to the fixed setting temperature or less by this refrigerating operation, the cook-chill system rapidly stops the driving of the cook-chill chilling fan 23 and the cook-chill circulation fan 20. Thereafter, the circulating chilled air of the refrigerating chamber 12 flows naturally into the cook-chill chamber 19 through the second chilling air duct 16 and the connection hole 26.

On the other hand, either the timer 29 or the temperature detecting sensor 27 may be unnecessary. For example, only the timer 29 can be used, or only the temperature detecting sensor 27 can be used, wherein the cook-chill chilling fan 23 and the cook-chill circulation fan 20 are simultaneously driven until the temperature of the cook-chill chamber 19 is decreased to the predetermined temperature or less. In addition, in a case where both the timer 27 and the temperature detecting sensor 29 are used simultaneously, the step ST7 which is performed by using the temperature detecting sensor 27 may be performed earlier than the step ST4, which is performed by using the timer 29.

While the present invention has been particularly shown and described with reference to a particular embodiment thereof, it will be understood by those skilled in the art that various changes and modifications can be made within the scope of the invention as hereinafter claimed.

What is claimed is:

1. A method for controlling a cook-chill system of a refrigerator/freezer combination, comprising the steps of:

(a) supplying first chilled air into a cook-chill chamber through a first chilled air inlet hole of the cook-chill chamber by driving a cook-chill chilling fan when receiving system operating instructions, the first chilled air being circulated to an evaporator from a freezing chamber;

(b) supplying second chilled air into the cook-chill chamber through a second chilled air inlet hole of the cook-chill chamber, the second chilled air being circulated in a chilling air duct for connecting a refrigerating chamber with a refrigerator fan, circulating the first and second chilled air in the cook-chill chamber by driving simultaneously a cook-chill circulation fan and the cook-chill chilling fan, and discharging the circulated chilled air through a chilled air discharge hole of the cook-chill chamber; and (c) controlling the driving of the cook-chill chilling fan and the cook-chill circulation fan to lower an inner temperature of the cook-chill chamber below a predetermined temperature.

2. The control method as claimed in claim 1, wherein said step (c) is performed by stopping the driving of the cook-chill circulation fan when a predetermined cook-chill operating time elapses, continuously checking the inner temperature of the cook-chill chamber, stopping the cook-chill circulation fan when the inner temperature of the cook-chill chamber falls below the predetermined temperature, and driving the cook-chill circulation fan and cook-chill chilling fan simultaneously by redriving the cook-chill chilling fan when the inner temperature of the cook-chill chamber rises to or above the predetermined temperature, and then stopping the cook-chill chilling fan and the cook-chill circulation fan when the inner temperature of the cook-chill chamber falls below the predetermined temperature.

3. A cook-chill system of a refrigerator/freezer combination comprising:

(a) a cook-chill chamber which is a three dimensional storage room for chilling rapidly and preserving a cooked foodstuff, and has a first chilled air inlet hole formed at an upper side thereof which is connected with a first chilling air duct between an evaporator and a freezing chamber, and has a second chilled air inlet hole formed at a side thereof adjacent to an upper layer connected with a second chilling air duct extending to a refrigerating chamber from the freezing chamber;

(b) a cook-chill chilling fan which is provided at the first chilled air inlet hole, for flowing forcibly a chilled air of a freezing chamber into said cook-chill chamber;

(c) a cook-chill circulation fan which is provided at the second chilled air inlet hole, for circulating the chilled air in said cook-chill chamber; and (d) a control means for controlling the driving of said cook-chill chilling fan and said cook-chill circulation fan in order to lower an inner temperature of the cook-chill chamber below a predetermined temperature.

4. The cook-chill system of a refrigerator/freezer combination according to claim 3, wherein said control means simultaneously drives said cook-chill chilling fan and said cook-chill circulation fan for a predetermined time by receiving a system driving instruction and then stops the driving of said cook-chill chilling fan and said cook-chill circulation fan.

5. The cook-chill system of a refrigerator/freezer combination according to claim 3, wherein said control means drives simultaneously said cook-chill chilling fan and said cook-chill circulation fan until an inner temperature falls to a predetermined temperature or less by receiving a system driving instruction, and then stops the driving of said cook-chill chilling fan and said cook-chill circulation fan.

6. The cook-chill system of a refrigerator/freezer combination according to claim 3, wherein said control means drives simultaneously said cook-chill chilling fan and said cook-chill circulation fan for a predetermined time by receiving a system driving instruction, and then stops the driving of said cook-chill circulation, stops the driving of said cook-chill circulation fan when an inner temperature of the cook-chill chamber falls below a predetermined temperature, or redrives said cook-chill chilling fan when the temperature of the cook-chill chamber rises to the fixed value or more and then stops the driving of said cook-chill chilling fan and said cook-chill circulation fan when the temperature of the cook-chill chamber falls to the fixed value or less.

7. The cook-chill system of a refrigerator/freezer combination according to claim 3, further comprising:

an isolation wall having a connection hole at a center thereof in order to form a chilled air path between the refrigerating chamber and said cook-chill chamber, wherein said isolation wall severs the second chilling air duct and simultaneously separates an upper side of the refrigerating chamber from the rear space of a side having the second chilled air inlet hole.

8. The cook-chill system of a refrigerator/freezer combination according to claim 3, wherein said cook-chill chamber has at least one chilled air discharge hole at a side surface of said cook-chill chamber.

9. The cook-chill system of a refrigerator/freezer combination according to claim 3, wherein said cook-chill chamber has two chilled air discharge holes which are formed both sides centering a portion where said second chilled air inlet hole of the cook-chill chamber is formed.

10. The cook-chill system of a refrigerator/freezer combination comprising:

(a) a cook-chill chamber which is a three dimensional storage room for chilling rapidly and preserving a cooked foodstuffs, has a first chilled air inlet hole at a back upper side of said cook-chill chamber, the first chilled air inlet hole being connected with a first chilling air duct between an evaporator and a freezing chamber in order to allow the chilled air of the freezing chamber to flow in, has at least one chilled air discharge hole in order to discharge the chilled air circulating in said cook-chill chamber and has a second chilled air inlet hole which is formed at an adjacent side to the back upper side;

(b) a cook-chill chilling fan which is provided at the first chilled air inlet hole, for allowing a chilled air of said first chilling air duct a freezing chamber to flow into said cook-chill chamber;

(c) a cook-chill circulation fan which is provided at the second chilled air inlet hole, for circulating the chilled air in said cook-chill chamber;

(d) an isolation wall having a connection hole at a center thereof in order to form a chilled air path between the refrigerating chamber and said cook-chill chamber, wherein said isolation wall severs the second chilling air duct and simultaneously separate an upper side of the refrigerating chamber from the rear space of a side having the second chilled air inlet hole; and (e) a control means for controlling the driving of said cook-chill chilling fan and said cook-chill circulation fan in order to decrease an inner temperature of the cook-chill chamber below a predetermined temperature.

11. The cook-chill system of a refrigerator/freezer combination according to claim 10, wherein the chilled air discharge hole is provided at both sides of the second chilled air inlet hole.

12. The apparatus for a cook-chill system of a refrigerator/freezer combination according to claim 10, wherein said control means has a timer for counting an operating time, and has a control unit for starting the driving of said cook-chill chilling fan and said cook-circulation fan by receiving a system driving instruction, and stopping said two cook-chill chilling fan and said cook-circulation fan when a predetermined time has passed by checking based on an output signal of the timer.

13. The cook-chill system of a refrigerator/freezer combination according to claim 10, wherein said control means has a temperature detecting sensor for detecting an inner temperature of said cook-chill chamber, and has a control unit for starting simultaneously the driving of said cook-chill chilling fan and said cook-circulation fan by receiving a system driving instruction and stopping said cook-chill chilling fan and said cook-circulation fan when an inner temperature of said cook-chill chamber checked by the output signal of the temperature detecting sensor is below a predetermined temperature.

14. The apparatus for a cook-chill system of a refrigerator/freezer combination according to claim 10, wherein said control means has a timer for counting the operating time;

a temperature detecting sensor for detecting an inner temperature of said cook-chill chamber; and a control unit for starting simultaneously the driving of said cook-chill chilling fan and said cook-chill circulation fan by receiving a system driving instruction, and stopping the cook-chill chilling fan when a predetermined time has passed by checking an output signal of said timer, then stopping said cook-chill circulation fan when an inner temperature of said cook-chill chamber checked by an output signal of the temperature detecting sensor is below a predetermined temperature, redriving said cook-chill chilling fan when the inner temperature of the cook-chill chamber is higher than the predetermined temperature, and then stopping said cook-chill chilling fan and said cook-chill circulation fan when the inner temperature of the cook-chill chamber falls to the predetermined temperature.

* * * * *